US006503370B2

(12) United States Patent
Hollmark et al.

(10) Patent No.: US 6,503,370 B2
(45) Date of Patent: Jan. 7, 2003

(54) METHOD OF PRODUCING A PAPER HAVING A THREE-DIMENSIONAL PATTERN

(75) Inventors: Holger Hollmark, Stockholm (SE); Lennart Reiner, Karlstad (SE); Thomas Billgren, Kullavik (SE); Kaveh Tondkar, Göteborg (SE); Mats Söderberg, Sundvall (SE); Bengt Järrehult, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/822,367

(22) Filed: Apr. 2, 2001

(65) Prior Publication Data

US 2002/0124978 A1 Sep. 12, 2002

Related U.S. Application Data

(63) Continuation of application No. PCT/SE99/01720, filed on Sep. 29, 1999.

(30) Foreign Application Priority Data

Oct. 1, 1998 (SE) ..... 9803358

(51) Int. Cl.[7] ..... D21F 11/00; D21F 3/02; D21H 17/28; D21H 17/33

(52) U.S. Cl. ..... 162/117; 162/109; 162/206; 162/211; 162/164.1; 162/168.3; 162/168.1; 162/165; 162/166; 162/175; 162/177; 162/169

(58) Field of Search ..... 162/109, 111, 162/113, 116–117, 204–207, 211, 361–362, 358.5, 164.1, 164.6, 168.1, 168.3, 164.3, 175, 166, 189, 179, 177; 34/397–400, 419, 423–426, 442, 446

(56) References Cited

U.S. PATENT DOCUMENTS

| | | | | | |
|---|---|---|---|---|---|
| 1,699,760 | A | * | 1/1929 | Sherman | 162/195 |
| 2,771,363 | A | * | 11/1956 | Fish | 162/116 |
| 2,862,251 | A | * | 12/1958 | Kalwaites | 264/119 |
| 3,025,585 | A | * | 3/1962 | Griswold | 28/106 |
| 3,034,180 | A | * | 5/1962 | Greiner et al. | 19/301 |
| 4,324,613 | A | * | 4/1982 | Wahren | 162/111 |
| 5,126,015 | A | * | 6/1992 | Pounder | 162/206 |
| 5,404,654 | A | * | 4/1995 | Babinsky et al. | 34/122 |
| 5,439,559 | A | * | 8/1995 | Crouse | 162/358.5 |
| 5,503,715 | A | * | 4/1996 | Trokhan et al. | 162/296 |
| 5,527,428 | A | * | 6/1996 | Trokhan et al. | 162/116 |
| 5,598,642 | A | * | 2/1997 | Orloff et al. | 34/388 |
| 5,656,132 | A | * | 8/1997 | Farrington, Jr. et al. | 162/117 |
| 5,672,248 | A | * | 9/1997 | Wendt et al. | 162/109 |
| 6,049,998 | A | * | 4/2000 | Crouse et al. | 34/445 |
| 6,223,450 | B1 | * | 5/2001 | Banerjee | 34/116 |
| 6,309,512 | B1 | * | 10/2001 | Bengtsson et al. | 162/358.5 |

FOREIGN PATENT DOCUMENTS

| | | |
|---|---|---|
| EP | 0 490 655 | 6/1992 |

* cited by examiner

*Primary Examiner*—Jose A. Fortuna
(74) *Attorney, Agent, or Firm*—Young & Thompson

(57) ABSTRACT

Method of producing paper having a three-dimensional pattern of alternating raised and recessed portions which is given the paper in connection with impulse drying, at which the wet paper web is passed through at least one press nip (12) comprising a rotatable roll (13) which is heated and that the paper web when passing through the press nip is given a three-dimensional pattern either by means of a pattern wire (11) and/or by the fact that the heated roll (13) is provided with a three-dimensional pattern, and where the wet paper web (10) before entering said press nip (12) is given a basis weight variation in a non-random pattern.

16 Claims, 4 Drawing Sheets

METHOD OF PRODUCING A PAPER HAVING A THREE-DIMENSIONAL PATTERN

This is a continuation of co-pending international application No. PCT/SE99/01720 filed on Sep. 29, 1999, which designated the United States of America.

TECHNICAL FIELD

Method of producing a paper having a three-dimensional pattern of alternating raised and recessed portions which is given the paper in connection with impulse drying, at which the wet paper web is passed through a press nip comprising a rotatable roll which is heated and that the paper web when passing through the press nip is given a three-dimensional pattern of alternating raised and recessed portions either by means of a pattern wire and/or by the fact that the heated roll is provided with a pattern intended to be pressed into the paper web against a holder-on.

BACKGROUND OF THE INVENTION

Moist paper webs are usually dried against one or more heated rolls. A method which is commonly used for tissue paper is so called Yankee drying. At Yankee drying the moist paper web is pressed against a steam-heated Yankee cylinder, which can have a very large diameter. Further heat for drying is supplied by blowing of heated air. If the paper to be produced is soft paper the paper web is usually creped against the Yankee cylinder. The drying against the Yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the through-air-dryer is then only vacuum dewatered and has a dry content of about 25–30% and is dried in the through-air-dryer to a dry content of about 65–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the pattern structure of the drying fabric is transferred to the paper web. This structure is essentially maintained also in wet condition of the paper, since it has been imparted to the wet paper web. A description of the TAD technique can be found in e.g. U.S. Pat. No. 3,301,746.

Impulse drying of a paper web is disclosed in e.g. SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is e.g. accomplished by gas burners or other heating devices, e.g. by means of electromagnetic induction. By the fact that the heat transfer to the paper mainly occurs in a press nip an extraordinarily high heat transfer speed is obtained. All water that is removed from the paper web during the impulse drying is not evaporated, but the steam on its way through the paper web carries along water from the pores between the fibers in the paper web. The drying efficiency becomes by this very high.

In EP-A-0 490 655 there is disclosed the production of a paper web, especially soft paper, where the paper simultaneously with impulse drying is given an embossed surface. This embossment is made by pressing a pattern into the paper from one or both sides against a hard holder-on. This gives a compression of the paper and by this a higher density in certain portions just opposite the impressions and a lower density in the intermediate portions.

In DE-A-26 15 889 there is disclosed a thermobonded embossed soft paper. Thermoplastic fibers are added to the paper web and after drying thereof the paper web is heated to a temperature exceeding the softening temperature of the thermoplastic fibers. Simultaneously with this heating the paper is pattern embossed. Through-air-drying is mentioned as a drying method.

THE OBJECT AND MOST IMPORTANT FEATURES OF THE INVENTION

The object of the present invention is to provide a method of producing an impulse dried paper having a three-dimensional pattern, e.g. a soft paper intended as toilet paper, kitchen rolls, paper handkerchiefs, table napkins and the like, and where the paper has a high bulk, high elasticity and a high softness. It is further a desire that the method should provide a controlled and broad pore volume distribution in the paper in order to optimize the absorption properties thereof. The paper structure should also essentially be maintained also in wet condition. This has according to the invention been provided by the fact that the wet paper web before entering said press nip is given a basis weight variation in a non-random pattern.

The basis weight variation that is given the paper during forming and dewatering is permanented in the following impulse drying step, at which the structure is essentially maintained also in wet condition of the paper.

According to a preferred embodiment of the invention the paper web is formed and/or dewatered on a wire whose dewatering capacity varies according to said non-random pattern and where the differences in dewatering capacity involves a certain movement of fibers and by that a local change of the basis weight of the paper web.

According to another embodiment the paper web is formed and/or dewatered in a converging forming space which on one side is delimited by a flat stationary or movable wall and on the other side by a wire having raised portions on the points where the wire threads are crossing each other, at which during dewatering in the converging forming space fibers are transferred from the raised portions of the wire cloth to intermediate portions resulting in a local change of the basis weight.

Further features and advantages of the invention are disclosed in the following description and in the dependant claims.

BRIEF DESCRIPTION OF THE DRAWINGS

The invention will in the following be closer described with reference to some embodiments shown in the accompanying drawings.

DESCRIPTION OF THE INVENTION

Figure 1:
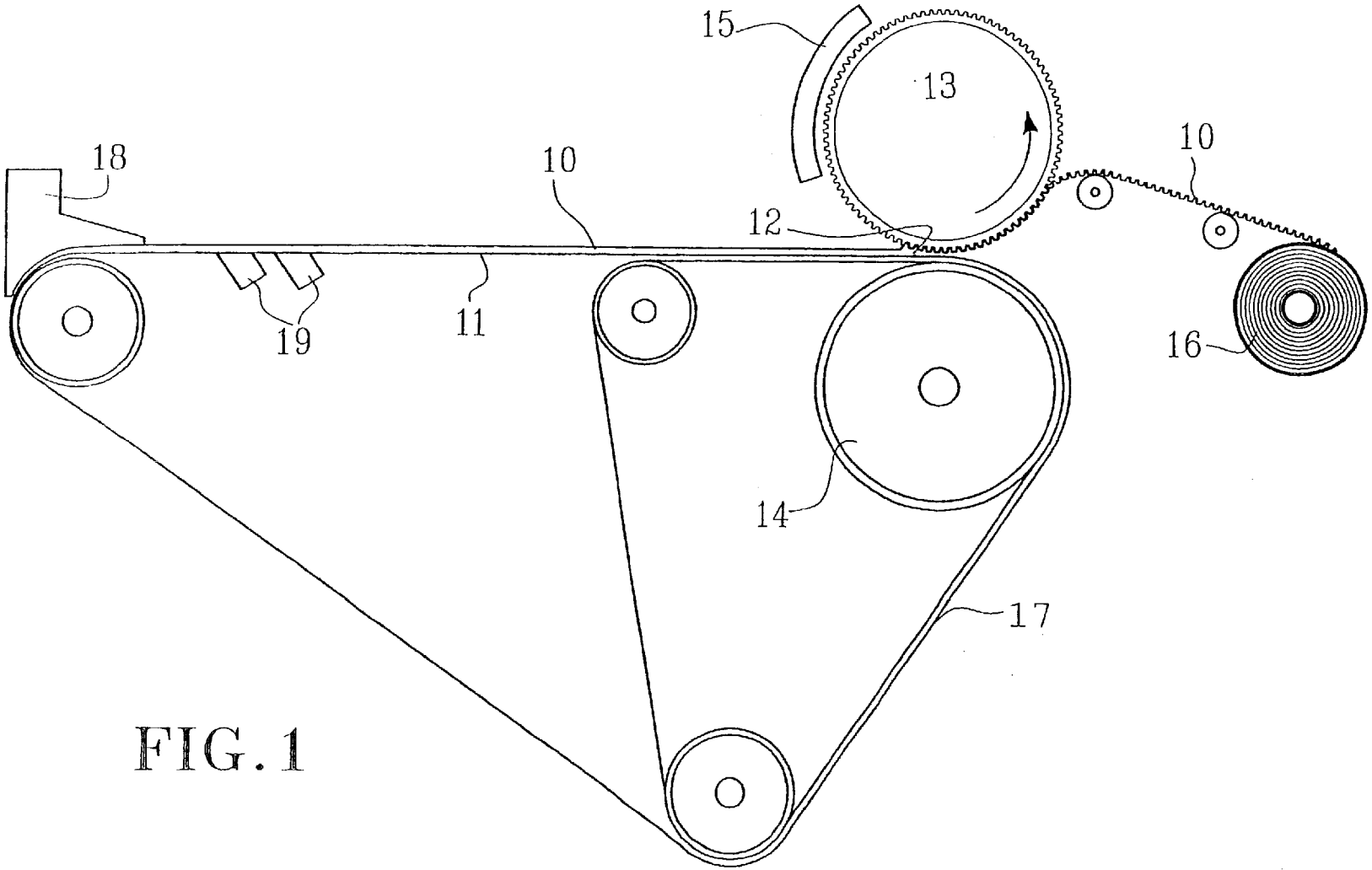
FIGS. 1 and 2 are schematic side views of an impulse drying device according to two different embodiments.

FIG. 1 shows schematically a device for forming, dewatering and drying a paper web. The paper web 10 is formed by means of a headbox 18 on a wire 11 and dewatered over suction boxes 19. The wire 11 is so designed that its dewatering capacity varies according to a certain pattern and where the differences in dewatering capacity involves a certain displacement of fibers and by that a local change of the basis weight of the paper web. Such a wire can consist of a coarse wire, in which the crossing sites between wire threads form raised portions with recessed portions therebetween. During dewatering on such a wire fibers are displaced from the raised portions and are collected in the recessed portions therebetween, at which a basis weight variation is obtained in the paper web according to a pattern corresponding to the three-dimensional pattern of the wire 11. Simultaneously with the basis weight variation there is obtained different mean pore volumes in the different portions of the paper web, so that the portions having the lowest basis weight, where the fibers are more sparsely distributed, will have a larger mean pore volume as compared to the portions having the higher basis weight.

The dewatered but still wet paper web 10, which is supported by the wire 11 and a felt 17, is entered into a press nip 12 between rotatable rolls 13 and 14, at which the roll 13 which is in contact with the paper web 10 by means of a heating device 15 is heated to a temperature which is sufficiently high in order to provide drying of the paper web. The surface temperature of the heated roll 13 may vary depending on such factors as moisture content of the paper web, thickness of the paper web, contact time between the paper web and the roll and the desired moisture content in the finished paper web. The surface temperature may of course not be so high that the paper web is damaged. A suitable temperature should be in the interval 100–400° C., preferably 150–350° C. and more preferably 200–350° C.

The paper web is pressed against the heated roll 13 by means of the roll 14. The press device may of course be constructed in many other ways. Two or more press devices may also be arranged after each other. The holder-on 14 may also be a press shoe. The function of the felt 17 is to improve the dewatering effect and extend the press nip. The felt 17 may however be eliminated.

A very rapid, violent and almost explosive steam generation takes place in the interface between the heated roll 13 and the moist paper web, at which the generated steam on its way through the paper web carries away water. For a further description of the impulse drying technique reference is made to the above mentioned SE-B-423 118 and e.g. to EP-A-0 337 973 and U.S. Pat. No. 5,556,511.

Simultaneously with the impulse drying the paper is given a three-dimensional structure by the fact that the heated roll 13 is provided with an embossing pattern in the form of alternating raised and recessed portions. This structure is substantially maintained also in a later wetted condition of the paper, since it has been imparted the wet paper web in connection with drying thereof. Since the term embossing is normally used for a shaping performed on dried paper we have in the following used press moulding for the three-dimensional shaping of the paper that occurs simultaneously with the impulse drying. By this press moulding the bulk and absorption capacity of the paper is increased, which for soft paper are important qualities.

The paper web may also be pressed against a non-rigid surface, e.g. the compressible press felt 17. The roll 14 may also have a flexible surface, e.g. an envelope surface of rubber. The paper is herewith given a three-dimensional structure having a total thickness greater than that of the unpressed paper. By this a high bulk, high absorption and high softness of the paper is achieved. The paper further becomes elastic. At the same time there is obtained a locally varying density in the paper.

The paper web may also be pressed against a hard surface, e.g. a wire 11 and/or a roll 14 having a rigid surface, at which the pattern of the heated roll 13 is pressed into the paper web under a heavy compression of the paper just opposite the impressions, while the portions therebetween are kept uncompressed.

The paper is after drying wound on a wind-up roll 16. If desired the paper can be creped before winding. It is however noted that the need for creping the paper in order to impart softness and bulk which is aimed at for soft paper, is reduced when using the impulse drying method according to the invention, since the paper by the three-dimensional structure and the chosen pattern is imparted bulk and softness.

The paper web can before it is entered into the impulse dryer either be only dewatered over suction boxes or besides be slightly pressed.

Figure 2:
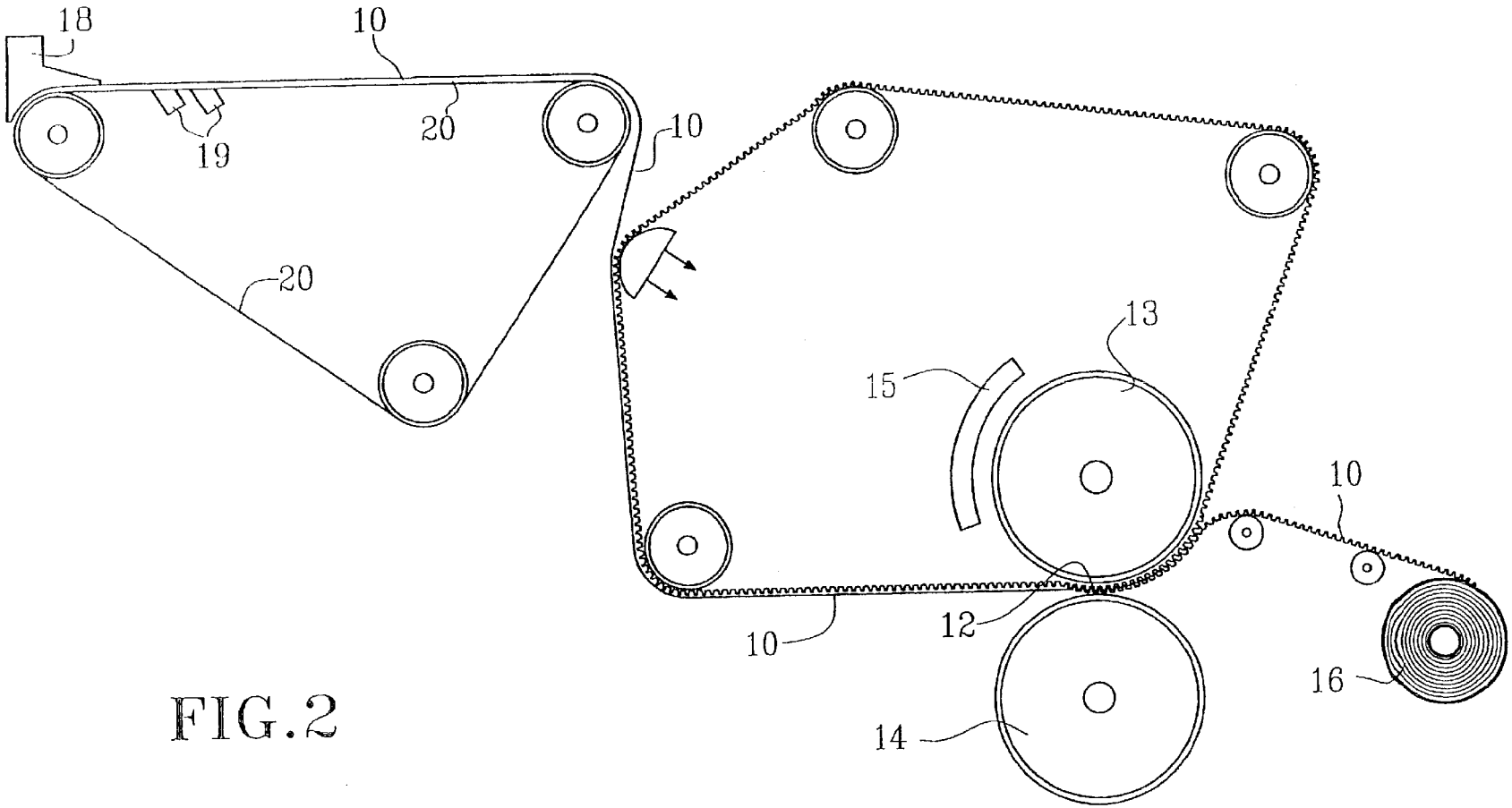

According to the embodiment shown in FIG. 2 the paper web 10 is formed and dewatered on a wire 20 which provides as basis weight variation in the paper web and is then transferred to a drying wire 11 or felt before it passes the impulse drying step with the rolls 13 and 14. The drying wire or felt 11 can either be essentially smooth, at which the roll 13 as described above has a three-dimensional pattern. Alternatively the wire 11 has a three-dimensional pattern, which is press moulded into the paper web as this passes through the press nip 12 between the rolls 13 and 14. The roll 13 may then either be smooth, as is shown in FIG. 2 or be provided with an embossing pattern. In case the roll 13 is smooth the press moulded paper will have one smooth surface and one surface with impressions. In case the roll 13 is provided with an embossing pattern this will also be pressed into the paper, which thus on one side will have a pattern corresponding to the wire structure 11 and on the opposite side corresponds to the embossing pattern of the roll. The patterns may but need not coincide and/or may be the same or different. According to a further embodiment a pattern band or belt extend around the roll and is heated thereby. The pattern of the band or belt is press moulded into the paper web as this passes through the press nip between the rolls 13 and 14.

Figure 3:
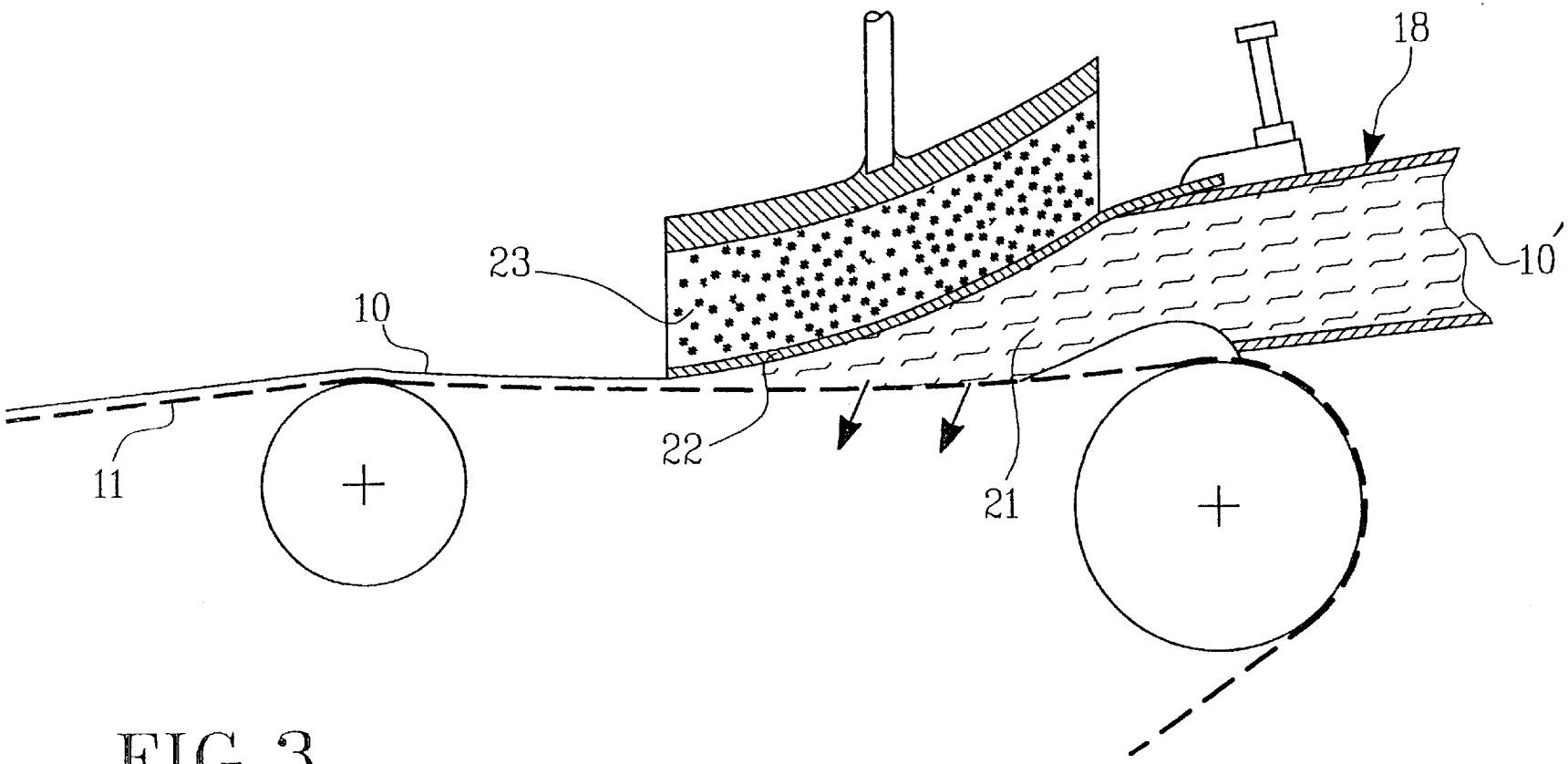
FIG. 3 shows a device for forming a paper web according to another embodiment.

According to the embodiment shown in FIG. 3 the fiber furnish 10' is supplied through a headbox 18 into a converging forming space 21 which on one side is delimited by a flat stationary or movable wall 22 and on the other side by a wire 11. The paper web 10 is formed and dewatered in the converging forming space 21. The wall 22, which preferably is flexible, is loaded by a pressure device 23 with a static pressure. The wire 11 provides during dewatering in the converging forming space 21 a basis weight variation of the paper web in a corresponding way as described above. A forming device according to FIG. 3 is closer described in SE-B-428 575.

The basis weight variation that has been imparted to the paper web 10 during forming and dewatering is permanented in the following impulse drying step, at which the structure is essentially maintained also when the paper is wetted.

Figure 4:
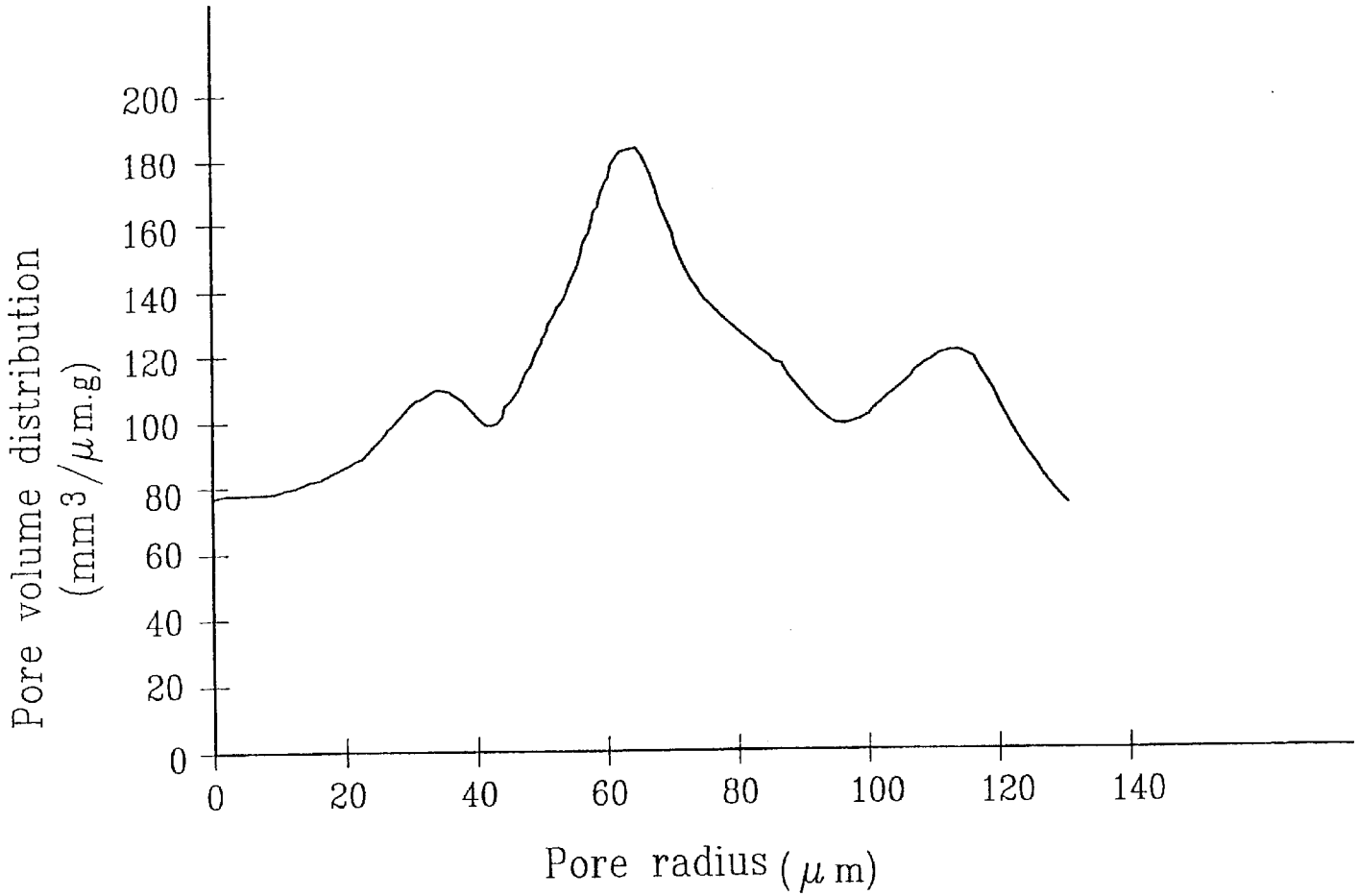
FIG. 4 shows an example of a PVD (pore volume distribution) graph of a paper.

By the combination of the locally varying basis weight variation in the paper and the three-dimensional pattern a broad pore volume distribution is provided, which is essential for absorption qualities. The fiber dimension of the fibrous material used, the dimension of the pattern which is given the paper in the press nip 12 in connection with impulse drying should be so adapted that the measured pore volume distribution of the finished paper should not be lower than 50 $mm^3/\mu m \cdot g$, preferably not lower than 70 $mm^3/\mu m \cdot g$, during any part of the pore volume interval 0–100 $\mu m$. Preferably the pore volume distribution of the finished paper should not be lower than 15 $mm^3/\mu m \cdot g$ during any part of the pore volume interval 0–320 $\mu m$. One example of a PVD (pore volume distribution graph) is shown in FIG. 4.

Possibly the paper web can after the first press nip and before winding on the wind-up roll 16 be passed through a further press nip (not shown) where a second impulse drying of the paper web takes place. This implies of course that the paper web before the second press nip is not completely dry but has a moisture content of at least 10 weight % and preferably at least 20 weight %. This can be achieved if the drying in the first impulse drying step in the press nip 12 is not complete and/or that the paper web is moistened before the second impulse drying step.

Simultaneously with both impulse drying steps the paper web is given a three-dimensional structure. The patterns can be pressed into the paper web from different sides thereof. It is of course also possible to press the different patterns into the paper web from the same side thereof. The patterns that are pressed into the paper web in the two impulse drying steps are preferably different.

According to one embodiment of the invention the paper web has a varying material composition as seen in its thickness direction, in such a way that it at least in the layer(s) that will be located closest to heated roll 13 in connection with the impulse drying contains a certain amount of a material which softens, melts or hardens in the temperature interval 100–400° C. By this the paper will get a surface layer which contributes in reinforcing the structural stability of the paper also in wet condition. The pulp composition in the rest of the paper layers can on the other hand be chosen for optimizing other properties such as softness, strength, bulk and draping qualities.

Said material which in connection with impulse drying softens, melts or hardens can consist of a wet strength agent, synthetic or natural polymers with thermoplastic properties, chemically modified lignin and/or synthetic or natural polymers in the presence of softening agents or of a lignin-containing high yield pulp.

The wet strength agent, which hardens at high temperatures, can consist of a polyamide amine epichlorhydrine resin, polyacryl amide resin, acrylic emulsion, urea-formaldehyde resin, polythene imine resin, a modified starch and/or a modified cellulose derivative. The content of wet strength agent in the layer which is intended to be located closest to the heated roll 13 should be at least 0.05 weight % calculated on the dry fiber weight.

Examples of materials that softens or melts in the temperature interval 100–400° C. are synthetic or natural polymers with thermoplastic properties, chemically modified lignin and/or synthetic or natural polymers in the presence of softening agents. The material can either be in the form of powder, flakes, fibers or an aqueous suspension, e.g. a latex dispersion. Examples of thermoplastic polymers are polyolefines such as polyethylene and polypropylene, polyesters etc.

By adding to the paper web said material, which is brought to soften or melt, there is achieved an increased amount of bonding sites in the paper web. By this the basis weight variation and three-dimensional structure, that has been imparted to the paper web in connection with the combined impulse drying and press moulding, is effectively permanented. This structure is maintained also in the wet condition of the paper.

Drying, thermobonding and press moulding can according to the invention take place in one and the same step—the impulse drying step—at which a more stable paper structure is obtained with a low degree of inner stresses, which otherwise easily occur if the paper is dried and the fiber structure locked before thermobonding.

As mentioned above the softening or melting material can according to the invention also consist of a lignin-containing high yield pulp, which will be described more in detail below.

Paper can be produced by a number of different pulp types. If one disregards recovery pulp, which today is used to a great extent mainly for toilet paper and kitchen rolls, the most commonly used pulp type for soft paper is chemical pulp. The lignin content in such pulp is practically zero and the fibers, which mainly consist of pure cellulose, are relatively thin and flexible. Chemical pulp is a low yield pulp since it gives a yield of only about 50% calculated on the wooden raw material used. It is therefore a relatively expensive pulp.

It is therefore common to use cheaper so called high yield pulps, e.g. mechanical, thermomechanical pulp, chemomechanical pulp (CMP) or chemothermomechanical pulp (CTMP) in soft paper as well as in other types of paper, e.g. newsprint paper, cardboard etc. In high yield pulps the fibers are coarser and contain a high amount of lignin, resins and hemicellulose. The lignin and the resins gives the fibers more hydrophobic properties and a reduced ability to form hydrogen bonds. The addition of a certain amount of chemothermomechanical pulp in soft paper has due to the reduced fiber-fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous-, easily dewatered- and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

Impulse drying takes place at a considerably higher temperature than e.g. Yankee drying or through-air-drying, at which according to a theory, to which however the invention is not bound, the softening temperature of the lignin present in the high yield pulp is reached during the simultaneous impulse drying and press moulding. When the paper becomes cooler the lignin stiffens again and contributes in permanenting the three-dimensional structure that has been given the paper. This is therefore essentially maintained also in the wet condition of the paper, which strongly improves the bulk and absorption qualities of the paper.

According to one embodiment of the invention the paper contains, at least in the layer(s) which is/are located closest to the heated rolls 13 during the impulse drying, a certain amount of a high yield pulp, said amount should be at least 10 weight % calculated on the dry fiber weight, preferably at least 30 weight % and more preferably at least 50 weight %. Other layers may contain any optional pulp or combination of different types of pulp in order to give desired qualities such as softness, strength, bulk etc. So does for example chemical pulp, preferably long-fibrous kraft pulp, provide a high strength of the paper. Recycled pulp may of course also be contained in the paper. The invention is however not bound to the use of a certain kind of pulp in the paper, but can be applied with any optional pulp or mixture of pulps.

The paper web is in this case formed in at least two separate layers, either by means of a multilayer headbox or by separate headboxes arranged after each other, at which the pulp composition in at least two layers are different.

It is of course also possible to combine different types of the above stated materials such as lignin-containing high yield pulp and wet strength agent and melting of softening materials respectively, in order to further reinforce the stabilizing effect of the pattern structure of the paper.

The paper web may also be formed in at least three separate layers, at which the two outer layers each contain a certain amount of said material that softens, melts or hardens in the temperature interval 100–400° C., such as a lignin-containing high yield pulp, a wet strength agent, synthetic or natural polymers with thermoplastic properties, chemically modified lignin and/or synthetic or natural polymers in the presence of softening agents.

Common additives such as wet strength agents, softening agents, fillers etc may of course also be used in the paper. The paper web can after impulse drying undergo different types of per se known treatments such as addition of different chemicals, further embossing, lamination etc. It is also possible when transferring the paper web between two different wires, e.g. from a dewatering wire to a drying wire, to have a speed difference between the wires so that the paper web is slowed down in connection with the transfer. The paper web will then be compacted to a certain extent, which further increases the softness qualities.

What is claimed is:

1. Method of producing a paper having a three-dimensional pattern of alternating raised and recessed portions by impulse drying, comprising the steps of:

passing a wet paper web through a press nip having a rotatable heated roll;

rendering a basis weight variation to the wet paper web in a non-random pattern before entering the press nip; and imparting a three-dimensional pattern of alternating raised and recessed portions onto the wet paper web by one of a pattern wire and a pattern on the heated roll by pressing the wet paper on the heated roll against a holder-on, so that the basis weight variation that is given to the wet paper web is superimposed on a density weight variation embossed in said imparting step.

2. Method as claimed in claim 1, characterized in that the paper web (10) is formed and/or dewatered on a wire (11;20) whose dewatering capacity varies according to said non-random pattern and where the differences in dewatering capacity involves a certain movement of fibers and by that a local change of the basis weight of the paper web.

3. Method as claimed in claim 1, characterized in that the paper web (10) is formed and/or dewatered in a converging forming space (21) which on one side is delimited by a flat stationary or movable wall (22) and on the other side by a wire (11) having raised portions on the points where the wire threads are crossing each other, at which during dewatering in the converging forming space fibers are transferred from the raised portions of the wire cloth to intermediate portions resulting in a local change of the basis weight.

4. Method as claimed in claim 1, wherein the fiber dimension of the fibrous material used, the dimension of the pattern according to which the basis weight of the paper varies and the dimension of the three-dimensional pattern which is given to the paper in the press nip in connection with impulse drying have been so adapted, that the pore volume distribution of the produced paper is not lower than 50 $mm^3/\mu m \cdot g$ in any part of the pore volume interval 0–100 $\mu m$.

5. Method as claimed in claim 4, characterized in that the fiber dimension of the fibrous material used, the dimension of the pattern according to which the basis weight of the paper varies and the dimension of the three-dimensional pattern which is given to the paper in the press nip (12) in connection with impulse drying have been so adapted, that the pore volume distribution of the produced paper is not lower than 15 $mm^3/\mu m \cdot g$ in any part of the pore volume interval 0–320 $\mu m$.

6. Method as claim 1, characterized in that the holder-on (11, 14) has a non-rigid surface so that the paper web is given a three-dimensional structure having a total thickness which is greater than the thickness of the unpressed paper web.

7. Method as claimed in claim 6, characterized in that the paper web is supported by a compressible press felt (11) through the press nip (12), said press felt forming said non-rigid holder-on.

8. Method as claimed in claim 7, characterized in that the press felt (11) is pressed against a resilient non-rigid surface (14) in the press nip (12).

9. Method as claimed in claim 1, wherein the paper contains at least 10% by weight, calculated on the dry fiber weight, of a lignin-containing high yield pulp.

10. Method as claimed in claim 1, wherein an effective amount of a material is added to the paper web that does one of soften, melt and harden in the temperature interval 100–400° C. to stabilize the pattern structure imparted to the paper web.

11. Method as claimed in claim 10, characterized in that said material comprises synthetic or natural polymers with thermoplastic properties, chemically modified lignin and/or synthetic or natural polymers in the presence of softening agents.

12. Method as claimed in claim 11, characterized in that said material comprises a wet strength agent.

13. Method as claimed in claim 12, characterized in that the wet strength agent is a polyamide amine epichlorhydrine resin, polyacryl amide resin, acrylic emulsion, urea formaldehyde resin, polythene imine resin, a modified starch and/or modified cellulose derivatives.

14. Method as claimed in claim 1, wherein the paper web has a varying material composition in a thickness direction, and that a layer of the paper web located closest to the heated roll contains an effective amount of a material which does one of soften, melt and harden in the temperature interval 100–400° C. to stabilize the pattern structure imparted to the paper.

15. Method as claim 1, characterized in that the wet paper web is passed through at least one further press nip (12) comprising a rotatable heated roll and that the paper web also when passing through said further press nip in connection with impulse drying is given a three-dimensional pattern with alternating raised and recessed portions.

16. Method as claimed in claim 1, wherein the paper is an absorbent soft paper.

* * * * *